United States Patent [19]

Dranchak

[11] 4,387,839

[45] Jun. 14, 1983

[54] DRUM SUPPORTING HARNESS

[76] Inventor: John S. Dranchak, 15 Jog Hill Rd., Trumbull, Conn. 06611

[21] Appl. No.: 268,568

[22] Filed: May 29, 1981

[51] Int. Cl.[3] ..... G10G 5/00

[52] U.S. Cl. ..... 224/265; 84/421; 224/910

[58] Field of Search ..... 224/265, 242, 252, 268, 224/271, 907, 269, 910, 255, 256, 266, 269; 84/421; 248/312.1, 311.2

[56] References Cited

U.S. PATENT DOCUMENTS

| | | | |
|---|---|---|---|
| 633,488 | 9/1899 | Reed | 84/421 |
| 757,987 | 4/1904 | Wiles | 224/255 |
| 909,217 | 1/1909 | Presba et al. | 224/265 X |
| 1,593,043 | 7/1926 | Stroecker | 248/312.1 X |
| 2,541,390 | 2/1951 | Weigand | 248/312.1 X |
| 3,021,744 | 2/1962 | Kester | 84/421 |
| 3,106,123 | 10/1963 | Johannsen | 84/421 |
| 4,158,980 | 6/1979 | Gauger | 84/421 |
| 4,256,007 | 3/1981 | Streit | 224/910 X |

*Primary Examiner*—Allan N. Shoap
*Assistant Examiner*—Robert Petrik
*Attorney, Agent, or Firm*—H. Gibner Lehmann; K. Gibner Lehmann

[57] ABSTRACT

A harness intended to be worn by a marching drummer, to support the drum in playing position at the front of the marcher. The harness comprises shoulder hooks supporting a center breast plate, from which a hanger structure depends. At the lower portion of the hanger structure there is an upwardly-facing hook means adapted to fit under and into a ledge on the drum wall. A spacer bar extends downward from the hook means, and has a forward-projecting abutment adapted for engagement with the side wall of the drum to maintain the latter in playing position while being supported by the hook means.

10 Claims, 6 Drawing Figures

DRUM SUPPORTING HARNESS

BACKGROUND

This invention relates to harnesses for use by marching drummers, to support the drum in playing position at the front of the marcher, and more particularly to harnesses of this type wherein mostly rigid metal components are utilized as contrasted with flexible straps and the like.

In the past various kinds of marching harnesses have been proposed and produced, for the above purpose. A number of these have consisted merely of canvas or leather belts equipped with buckles which are intended to hook onto a carrier piece or hanger strip that is supplied as part of the drum structure. While such belt-type harnesses have served a useful purpose, they had drawbacks inasmuch as the drum was not suppported firmly enough and tended to sway or move as the drummer walked. This would undesirably interfere with the playing of the instrument.

In order to overcome this, harnesses were proposed and produced where rigid or metallic members replaced the flexible straps. In large part these represented an improvement, but their attachment to the drum body left something to be desired. In many cases, the drum was not held sufficiently rigid to prevent sway during walking, due to looseness or poor fit between the harness and the drum body. Or, if the attachment that was provided was sufficiently secure and firm, then the drum could not be easily detached when desired, and again quickly attached.

Moreover, the adapting of the attachment means to the drum did not lend itself to easy execution, and expensive parts or assemblies were utilized, which undesirably increased the cost of the harness.

Additionally the matter of the comfort of the wearer or user was not considered, whereby discomfort was experienced which interfered with the proper playing of the drum.

SUMMARY

The above disadvantages and drawbacks of prior harnesses intended for supporting a drum in playing position while marching, are obviated by the present invention, which has for one object the provision of a novel and improved drum support harness for the above purpose, which is especially easy to apply to the drum and also easy to remove while at the same time firmly supports the instrument in playing position.

Another object of the invention is to provide an improved drum-support harness as above set forth, which is simple in its construction and economical to farbicate and produce, whereby the manufacturing cost can be kept low.

A further object of the invention is to provide an improved drum-support harness as characterized, which firmly and securely supports the drum in its proper playing position, thereby to facilitate the playing thereof.

Still another object of the invention is to provide an improved drum-support harness of the kind outlined above, which is particularly comfortable to use and wear whereby the drummer has the utmost freedom and ease in its use.

Still other features and advantages will hereinafter appear.

In accomplishing the above objects the invention provides a harness comprising a pair of shoulder hooks adapted to rest on the shoulders of the drummer, and a breast plate secured to and extending between said shoulder hooks at the chest level, said breast plate maintaining a predetermined spacing between the shoulder hooks. Depending from the breast plate is a hanger structure at the lower portion of which are provided upwardly-facing hook means which are adapted to fit under and into a ledge that is normally provided on the drum body. A spacer bar extends downward from the hook means, and a spacing abutment is carried by the spacer bar and extends forwardly therefrom, for engagement with a side wall of the drum to maintain the latter in a playing position while being supported by the hook means. Rigid with the hook means is a broad waist plate, which extends laterally on opposite sides thereof, for engagement with frontal portions of the drummer to provide support when the hook means mounts a drum. The spacing abutment is located somewhat forward of the hook means, thereby to cause the drum to present its playing surface at the most advantageous angle, for striking by the drumsticks. Preferably the hook means, spacer bar and spacing abutment are constituted of a single, U-shaped metal strip having legs of unequal length, provided with offset extremities whereby the fabrication of this portion of the harness is economically carried out. An adapter is provided for attachment to the drum body, in the form of a simple metal strip which is secured in place by bolts having wingnuts, the bolts carrying shouldered bushings by which a quick and easy, yet firm and secure separable joint is had with the hook means of the harness, and this constitues an important feature of the invention.

In the accompanying drawings, illustrating one embodiment of the invention:

Figure 1:
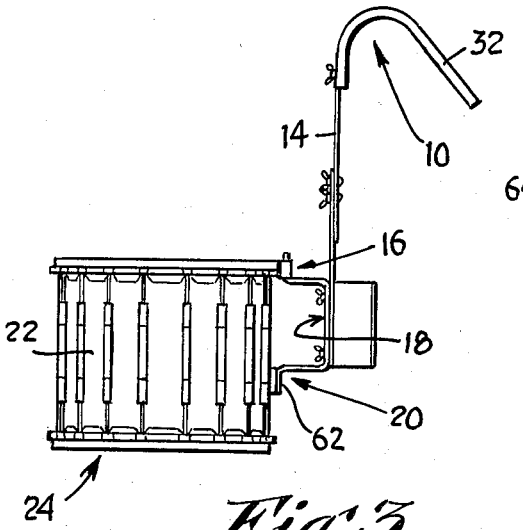
FIG. 1 is a side elevational view on a reduced scale, showing the improved harness of the invention supporting a drum in playing position.

Referring first to FIG. 1, the present improved drum-supporting harness basically comprises two shoulder hooks designated generally by the numeral 10, a breast plate 12 secured to the hooks 10, and a hanger structure 14 attached to the breast plate and depending therefrom. Carried by the lower portion of the hanger structure are upwardly-facing hook means 16, a spacer bar 18 extending downward from the hook means 16, and a spacing abutment 20 carried by the spacer bar and extending forwardly therefrom. The hook means 16 and the spacing abutment 20 engage respectively upper and lower portions of the annular body 22 of the drum 24.

Figure 4:
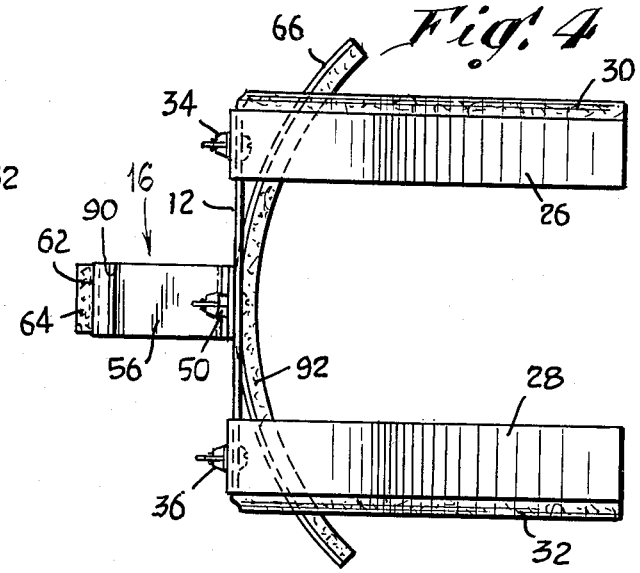
FIG. 4 is a top plan view of the harness.
Figure 3:
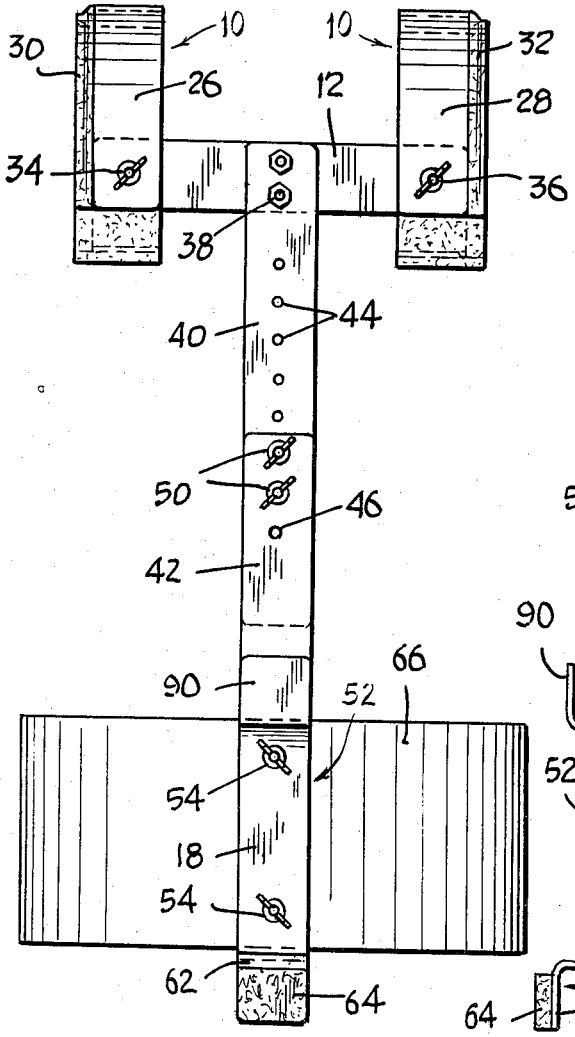
FIG. 3 is a front elevational view of the harness.

As seen in FIGS. 3 and 4, the two shoulder hooks are numbered specifically 26 and 28, having cushion pads or liners 30, 32 respectively.

As provided by the invention, pivot bolts 34, 36 having wing nuts, pivotally connect the shoulder hooks 26, 28 to the breast plate 12, and the latter is secured by bolts 38 to the upper extremity of the hanger structure 14.

In accordance with the invention, the hanger structure 14 is made adjustable or extensible, being constituted of an upper strip 40 and a lower strip 42, said strips overlapping each other and having plural apertures 44, 46 to accommodate bolts 50 by which the strips 40, 42 can be secured to each other in overlapping relation, in a number of different positions. By this arrangement the length or height of the hanger structure 14 can be adjusted to accommodate the harness to larger or smaller persons.

The lower extremity of the hanger structure 14 is secured to a U-shaped metal strip 52 by means of bolts 54, said U-shaped strip preferably constituting not only the hook means 16, but also the spacer bar 18 and the spacing abutment 20.

Figure 2:
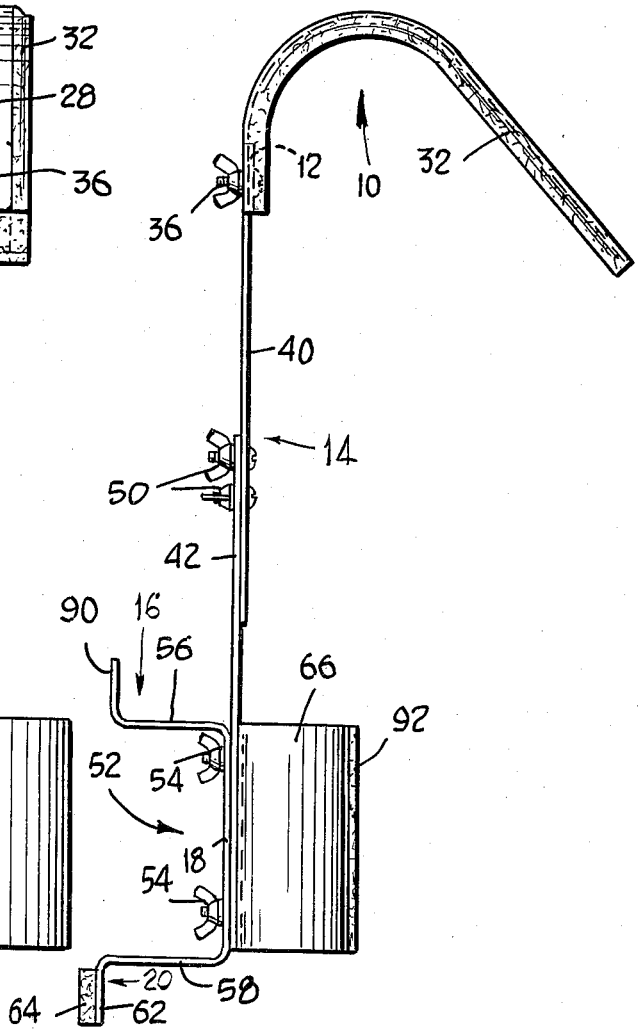
FIG. 2 is a side elevational view similar to that of FIG. 1 but on a larger scale, illustrating the construction in greater detail.

As seen in FIG. 2, the upper leg 56 of the U-shaped strip 52 is slightly shorter than the lower leg 58, and the upper leg has an upwardly offset portion 90 which constitutes part of the hook means. The lower leg 58 has a downwardly offset portion 62 which constitutes a pad, having a cushion liner 64 adapted to engage the side wall or body 22 of the drum 24.

As will be later brought out, the difference in the lengths of the legs 56 and 58 provides for a desirable positioning of the drum 24 at the proper playing angle, to facilitate the striking of the drum by the drumsticks.

According to the invention, the lower portion of the hanger structure 14 also carries a waist plate 66 which is curved somewhat and adapted to fit the frontal portion of the wearer. Preferably the waist plate 66 has a width, measured vertically, which is substantially equal to the length of the spacer bar 18 of the U-shaped metal strip 52. The waist plate 66 is secured to the hanger structure 14 by the bolts 54.

Figure 6:
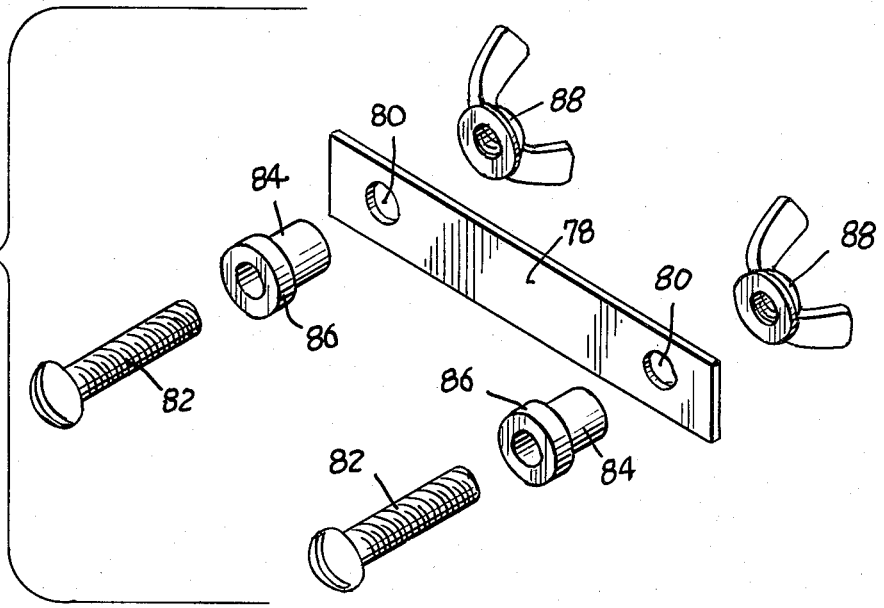
FIG. 6 is an exploded view of the adapter device of the invention.
Figure 5:
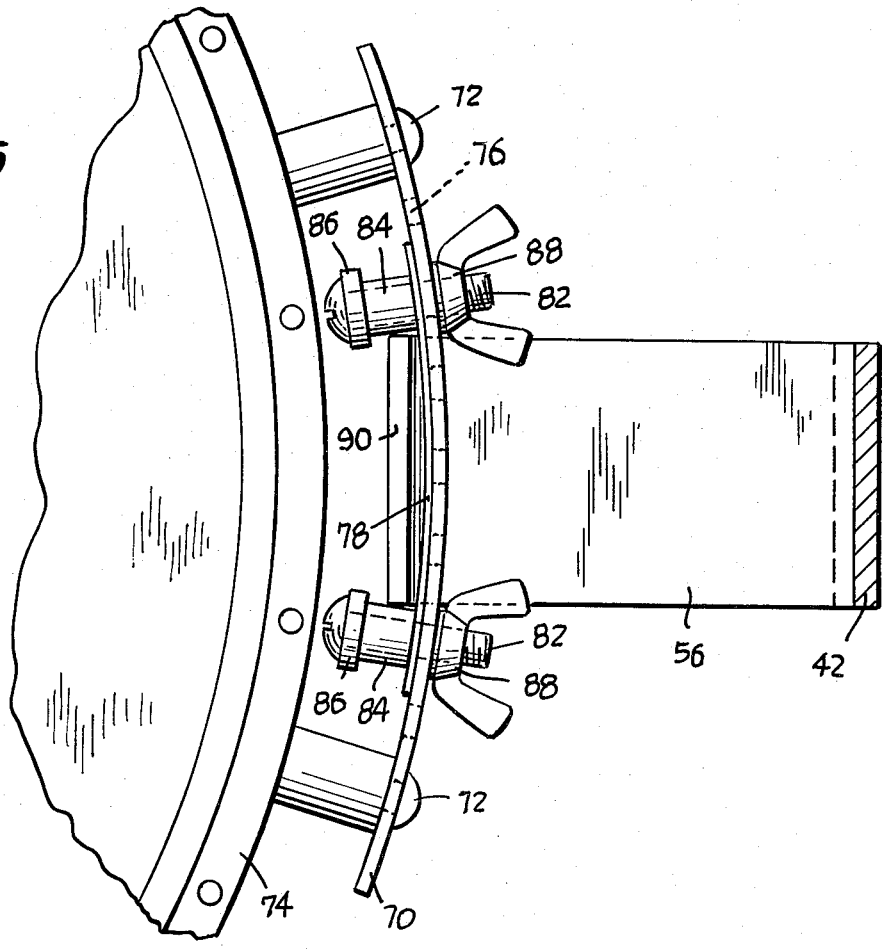
FIG. 5 is a fragmentray horizontal section showing the harness hook means and carrier strip of the drum, and showing in top plan view the adapter device attachable to the drum body.

In accordance with the present invention, a novel adapter assemblage is provided illustrated in FIG. 6, for attachment to the upper rim portion of the drum 24 to facilitate the connecting of the hook means 16 to the drum. As seen in FIG. 5, drums are usually provided with a short segment or hanger strip 70 which is attached by means of bolts 72 in spaced relation to the top rim 74 of the drum. The hanger strip 70 is provided with a plurality of holes 76 to accommodate hooks of flexible straps which were heretofore utilized as a harness, to carry the drum.

By the present invention there is provided a ledge or bridge plate 78 having apertures 80 adapted to receive bolts 82 which can secure the bridge plate 78 to the inner surface of the hanger strip 70, with the bolts 82 passing through two of the plurality of holes in the hanger strip. Further, according to the invention, the adapter assemblage comprises sleeves 84 having annular shoulders or flanges 86, said sleeves being carried by the bolts 82 and being in the nature of bushings thereon. The bolts 82 and sleeves or bushings 84 are hereinafter also collectively referred to as studs. The adapter assemblage is secured in place on the hanger strip 70 by tightening wingnuts 88.

As seen in FIG. 5, the spacing between the studs 84 enables the bill portion 90 of the hook means to be accommodated snugly between the studs, and to be confined on one side by engagement with the bridge plate 78 and on the other side by the shoulders 86 of the studs. By such arrangement there is provided a readily-separable connection between the hook means 16 and the drum body 22, such connection being devoid of excessive play or looseness and at the same time enabling the drum to be easily mounted on the hook means and de-mounted therefrom. As seen in FIG. 1, the offset portion 62 of the spacing abutment engages the lower portion of the drum body 22 and positions the body in the most advantageous way, for playing.

To provide the greatest comfort to the user, the waist plate 66 may be provided with a resilient pad or lining 92, as will be understood.

It can now be seen from the foregoing that I have provided a unique drum-supporting harness and adapter by which a drum can be easily and quickly mounted in playing position for a marching drummer. The harness and the adapter associated therewith are constituted of relatively few parts, and constitute a simple and economical construction while at the same time providing adequate support for the drum, with the maximum degree of comfort.

Variations and modifications are possible without departing from the spirit of the claims.

I claim:

1. As a new article of manufacture, a harness intended to be worn by a marching drummer for supporting a drum of the type having on the outside of its body a spaced, horizontal hanger strip, said harness comprising in combination:

(a) a pair of shoulder hooks adapted to rest on the shoulders of the drummer, (b) a breast plate secured to and extending between said shoulder hooks at the chest of the drummer, said breast plate maintaining a predetermined spacing between the shoulder hooks, (c) a hanger structure attached to the breast plate and depending therefrom, (d) upwardly-facing hook means comprising a horizontal leg having a vertical bill portion extending upward from the end of the leg, said hook means being carried by the lower portion of the hanger structure and being adapted to fit under the hanger strip on the drum and the bill portion thereof being adapted to extend upward in the space between the drum body and the hanger strip, (e) a spacer bar extending downward from the hook means, and (f) a spacing leg carried by the lower end of the spacer bar and extending forwardly therefrom, having an abutment at its forward end, said abutment being spaced from the spacer bar and adapted for engagement with a side wall of the drum to maintain the latter in playing position while being supported by said hook means, (g) all portions of the abutment on the spacing leg being disposed forwardly with respect to the hook means.

2. The invention as defined in claim 1, and further including:

(a) a waist plate rigid with said hook means and extending laterally on opposite sides thereof, for engagement with frontal portions of the drummer to provide support when the hook means mounts a drum.

3. The invention as defined in claim 1, wherein:

(a) said hanger structure comprises a pair of overlapping strips having plural apertures, and (b) bolts passing through apertures of the overlapping strips for securing the same in various adjusted positions to effect different overall lengths of the structure.

4. The invention as defined in claim 1, wherein:

(a) the shoulder hooks are pivotally secured to the breast plate to enable the hooks to be adjustably positioned.

5. The invention as defined in claim 1, and further including:

(a) a drum having a hanger strip, (b) a ledge on the drum comprising a bridge plate extending along the hanger strip of the drum and in spaced relation to the drum body, (c) a pair of studs secured to the said bridge plate in spaced relation with each other, and (d) shoulders on the studs, spaced from the said bridge plate, (e) said bill portion of the hook means engaging the bridge plate between said studs and being positionable by the latter and the shoulder thereof, while supporting the drum.

6. The invention as defined in claim 5, wherein:

(a) said drum hanger strip extends along and engages the bridge plate and is provided with a plurality of apertures, (b) said pair of studs passing through some of said apertures and mounting said bridge plate on the said hanger strip.

7. A drum comprising in combination:

(a) a body having annular side walls, (b) a bridge plate attached to an upper side wall of the drum in spaced relation therewith, (c) a pair of studs secured to the bridge plate in spaced relation with each other, and (d) shoulders on the studs spaced from the bridge plate and adapted to be engageable by a supporting hook which is inserted between the studs and in engagement with the bridge plate, said bridge plate, studs and shoulders being adapted to confine the supporting hook and restrict lateral movement thereof as it supports the drum.

8. The invention as defined in claim 7, wherein:

(a) said body has a hanger strip provided with a plurality of apertures, (b) said pair of studs passing through some of said apertures and mounting said ledge on the said horizontal hanger strip.

9. As a new article of manufacture, a harness intended to be worn by a marching drummer for supporting a drum, said harness comprising in combination:

(a) a pair of shoulder hooks adapted to rest on the shoulders of the drummer, (b) a breast plate secured to and extending between said shoulder hooks at the chest, said breast plate maintaining a predetermined spacing between the shoulder hooks, (c) a hanger structure attached to the breast plate and depending therefrom, (d) upwardly-facing hook means carried by the lower portion of the hanger structure, adapted to fit under and into a ledge on the drum, (e) a spacer bar extending downward from the hook means, (f) a spacing abutment carried by the spacer bar and extending forwardly therefrom and disposed forwardly with respect to the hook means, said spacing abutment being adapted for engagement with a side wall of the drum to maintain the latter in playing position while being supported by said hook means, (g) said hook means, spacer bar and spacing abutment being constituted of a single, U-shaped metal strip having legs of unequal length, and (h) the extremities of the legs of the metal strip being provided with offset portions one of which forms part of said hook means whereas the other comprises a pad for contact with the drum wall.

10. The invention as defined in claim 9, and further including:

(a) a waist plate rigid with said hook means and extending laterally on opposite sides thereof, for engagement with frontal portions of the drummer to provide support when the hook means mounts a drum, said waist plate having a vertical width substantially equal to the distance between the legs of the U-shaped metal strip.

* * * * *